United States Patent [19]

Rastogi et al.

[11] 4,362,269

[45] Dec. 7, 1982

[54] CONTROL SYSTEM FOR A BOILER AND METHOD THEREFOR

[75] Inventors: Laxmi K. Rastogi, San Jose; Arthur D. Allen; John Y. H. Tsing, both of Cupertino, all of Calif.

[73] Assignee: Measurex Corporation, Cupertino, Calif.

[21] Appl. No.: 243,170

[22] Filed: Mar. 12, 1981

[51] Int. Cl.[3] ..... F23N 1/08

[52] U.S. Cl. ..... 236/14; 110/188; 110/234; 110/341; 122/449; 236/15 E; 431/76

[58] Field of Search ..... 236/15 E, 14; 110/188, 110/185, 341, 234; 431/76, 10; 122/449

[56] References Cited

U.S. PATENT DOCUMENTS 1,602,092 10/1926 Witz ..... 110/188

3,607,117 9/1971 Shaw et al. ..... 236/15 E X 3,814,570 6/1974 Guigues ..... 236/15 E X 4,278,,052 7/1981 Sharp ..... 122/449

*Primary Examiner*—Edward G. Favors

*Attorney, Agent, or Firm*—Flehr, Hohbach, Test, Albritton & Herbert

[57] ABSTRACT

A method and system for controlling the combustion of, for example, coal or bark in a stoker boiler or black, liquor in a recovery boiler to provide operation at maximum efficiency. Control loops are provided for primary or undergrate air and secondary or overfire air. The undergrate air control loop is adjusted as a function of carbon dioxide or steam/fuel ratio, and the overfire air control loop is adjusted as a function of carbon monoxide. In addition to carbon monoxide, combustibles and opacity may be used. Air redistribution is also used to minimize combustibles or CO or opacity.

10 Claims, 7 Drawing Figures

| LAST $CO_2$ (S/F) MEASU. | LAST MOVE TO A/F | CURRENT MOVE TO A/F |
|---|---|---|
| INCREASE | INCREASE | INCREASE |
| INCREASE | DECREASE | DECREASE |
| DECREASE | INCREASE | DECREASE |
| DECREASE | DECREASE | INCREASE |

CONTROL SYSTEM FOR A BOILER AND METHOD THEREFOR

The present invention is directed to a control system for a stoker boiler and a method therefor and more particularly to a system where both the undergrate and overfire air is selectively controlled. Its principles are also directly applicable to recovery boilers such as those used in connection with the "black liquor" in the production of paper.

Stoker boilers are a class of boilers in which a solid fuel such as, for example, coal or bark is burned on a bed. In such a boiler, air is admitted both under the fire or fuel bed and are termed undergrate air and overfire. In general, the undergrate air initiates combustion and drives volatiles off the coal or wood bed, and the overfire air creates turbulent flow and combusts the carbon monoxide driven from the burning bed. In a recovery boiler, the undergrate air is actively admitted at the fire bed and called "primary" air and the overfire air is "secondary" air.

Unlike oil or gas fired boilers, a stoker boiler has at its hearth a burning bed. This bed must be taken care of at all times. For proper combustion control, one must ensure that the best possible use is made of the fuel that is being fired. Thus, the amount of excess air released up the stack should be reduced while at the same time reducing the loss due to incomplete combustion products ($CH_x$) going up the stack. While those are the primary objectives of combustion control on a gas or oil fired boiler, this is not the case for stoker or for that matter recovery boilers. In these boilers, one must also minimize the amount of unburned fuel in the ash or smelt as well as the release of combustibles ($CH_x$) through the stack.

In a fuel bed in a stoker boiler, it is known that there are many different combustion zones. For example, there is an oxidation zone where carbon is converted to carbon dioxide ($CO_2$) and where carbon dioxide may be reduced to carbon monoxide (CO). And then there are other zones. In any case, there are a very complex set of chemical reactions going on which will vary from boiler to boiler depending on many parameters. Recovery boilers have analogous reactions.

In order to achieve optimum combustion efficiency, flue gas analyzers have been provided which measure the amount of carbon monoxide, carbon dioxide and also combustibles ($CH_x$). And, of course, for the Environmental Protection Agency (EPA), measurements of nitrous or nitric oxides, sulfur dioxide and opacity (which is a measure of the soot or ash present in the flue gas) have been made. In addition, feed back control techniques have either been proposed or actually used where some of the above parameters were used to control efficiency of combustion. For example, the North American Combustion Handbook, 1978, second edition, published by the North American Manufacturing Company, points out on pages 67 and 68 that an optimum point of thermal efficiency might be achieved by producing the maximum percentage of carbon dioxide in the flue gas. In addition, control of undergrate air flow as function of the amount of carbon monoxide or oxygen in the exhaust to a selective target value has been done.

It is a general object of the present invention to provide an improved system and method therefor for optimization of combustion in a boiler.

In accordance with the above object, there is provided a control system and method therefor for a boiler producing steam having a fire bed of fuel where air is admitted under or at the fire bed (undergrate air) to accomplish the preliminary burning of fuel in the fire bed. Air is admitted over the fire bed (overfire air) for completing combustion. This system comprises means associated with the exhaust stack of the boiler for sensing carbon dioxide and carbon monoxide in the flue gas. The amount of undergrate air admitted into the boiler is controlled as a function of the carbon dioxide or steam/fuel ratio. The amount of overfire air admitted into the boiler is controlled as a function of carbon monoxide.

Figure 1:
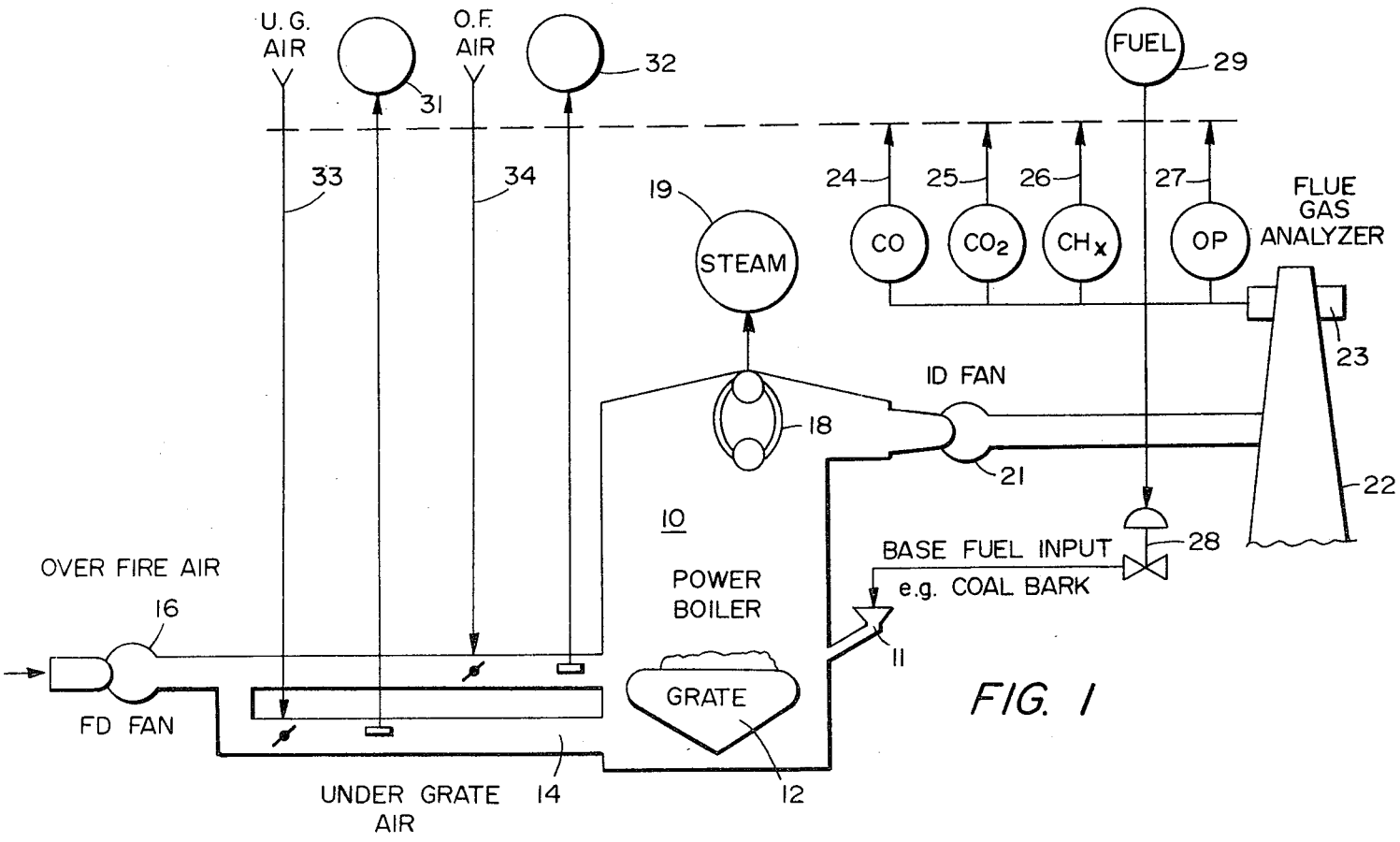
FIG. 1 is a diagrammatic view of a stoker boiler embodying the present invention.

Now referring to FIG. 1, this shows a power boiler 10 of the stoker type where fuel such as coal or bark is input at 11 onto a moving grate 12. Combustion is fed by means of overfire air 13 and undergrate air at 14. A forced draft (FD) fan 16 provides such air.

The fire bed 17 on the grate 12 generates steam in the boiler tubes 18 and the amount of steam output is designated at 19.

Flue gas is drawn out by an induction fan 21 into a stack 22. This stack has a flue gas analyzer 23 which has individual and known sensing units which indicate the amount of carbon monoxide (CO), carbon dioxide ($CO_2$), combustibles ($CH_x$) and the opacity (OP) in the flue gas. These are numbered 24 through 27 respectively. In addition, the control of the fuel input is schematically indicated by the gate unit 28; and the magnitude of the value is indicated by the circled fuel designation at 29.

From an input standpoint, the amounts of overfire and undergrate air are determined by sensors, the values being indicated at 31 and 32; and the control inputs for controlling such air flows by means of vents or dampers are indicated at 33 and 34.

Figures 2, 5:
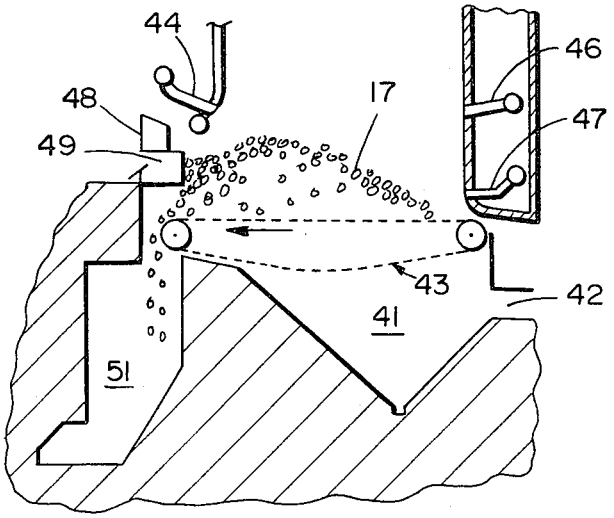
FIG. 2 is a detailed cross-sectional view of a stoker boiler as diagrammatically shown in FIG. 1.
FIG. 5 is a table illustrating the operation of FIG. 3.

The present invention in one application may be used with a spreader stoker as illustrated in FIG. 2. There is an air plenum at 41, with an undergrate air input 42, which is covered by a moving stoker chain 43. On the top of the stoker chain is carried the fire bed 17 where overfire air is admitted at the front, side and rear. Front overfire air is indicated at 44 and rear overfire air at 46 and 47. There is a coal hopper 48 and a feeder 49 which projects fuel into the furnace. The top of the stoker chain 43 moves toward an ash hopper 51.

In general, in a spreader stoker boiler, the fuel is projected over the fire with a uniform spreading action. This permits the suspension burning of fine fuel particles and the heavier pieces which cannot be supported in the gas flow fall to the moving grate for combustion in a thin, fast burning bed that moves toward the front of the boiler. This method of firing provides extreme sensitivity to load fluctuations since ignition is nearly instantaneous with an increase in firing rate. Moreover, the fuel bed can be burned out rapidly when desired.

Figure 3:
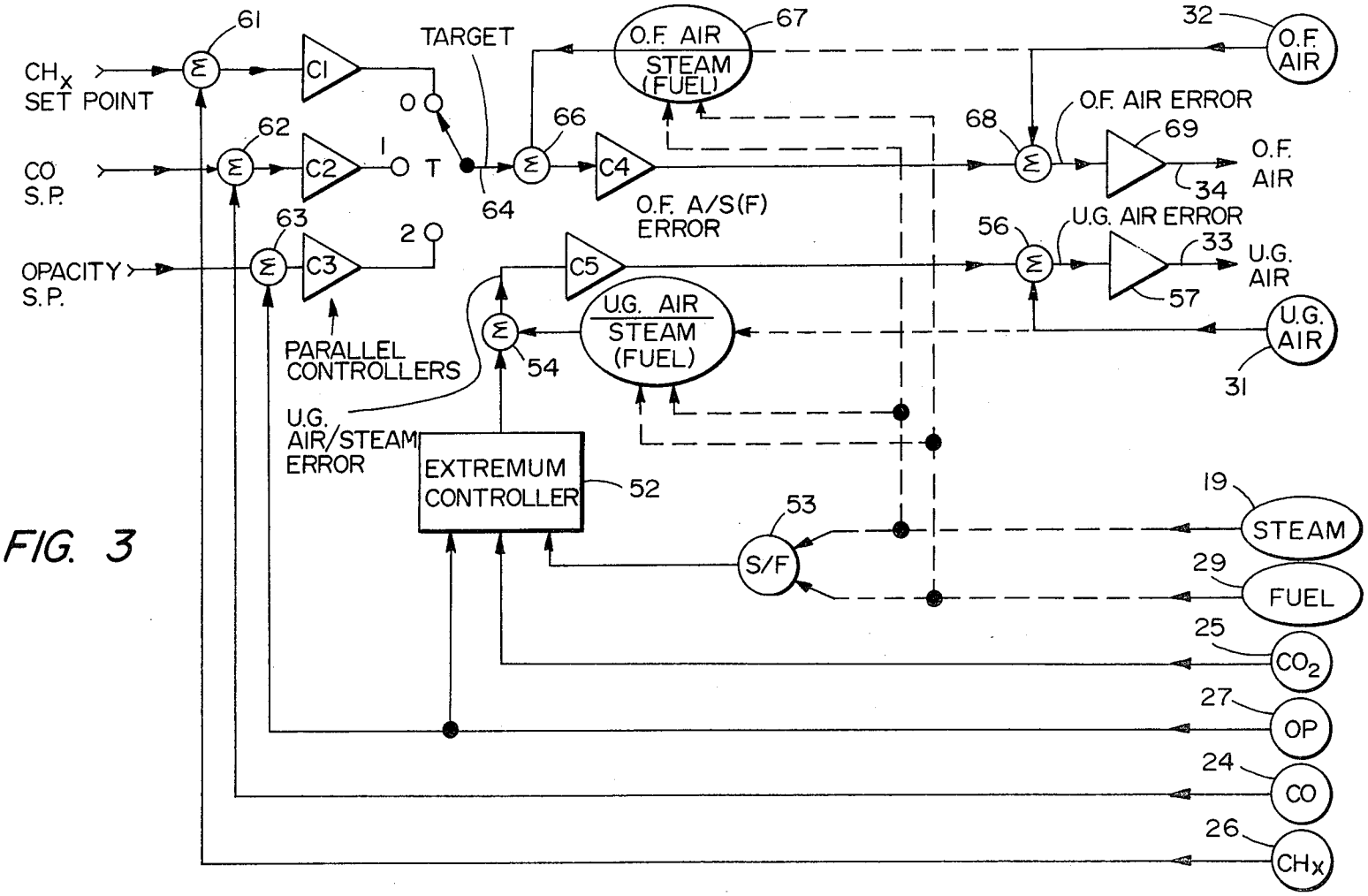
FIG. 3 is a circuit schematic of the control system embodying the present invention.

FIG. 3 illustrates the control system for the power boiler of FIG. 1; and at the right edge of FIG. 3, the various inputs and outputs are correlated. That is, several sensors sense the steam, fuel, carbon dioxide, opacity, carbon monoxide and combustibles. These are processed in a manner to be described below, and with the aid of the measurement of the existing undergrate (U.G.) and overfire (O.F.) air 31, 32, two control loops are established to readjust the respective air flows on lines 33, 34.

First, with regard to the undergrate air control loop, the concept is to maximize the carbon dioxide detected. Thus, the $CO_2$ detected at 25 is connected to an extremum controller unit 52 which by a hill climbing or stepping action senses the maximum carbon dioxide and changes the U.G. air at 33 accordingly. In other words, more simply put, the variation of carbon dioxide output with U.G. air as a parameter is a curve which has a maximum; and the U.G. air input is varied until a maximum amount of carbon dioxide is measured. Such extremum control is illustrated by the chart of FIG. 5 where moves of the U.G. air (as related to an assumed constant fuel input) are made. Whether the value of the last carbon dioxide measurement increases or decreases is noted until the extremum or maximum point is reached. Extremum control per se is known in the control art, for example, as discussed in an article entitled EXTREMUM CONTROL SYSTEMS-AN AREA FOR ADAPTIVE CONTROL? by Jan Sternsby produced in conjunction with the 1980 Joint Automatic Control Conference held Aug. 13–15, 1980 in San Francisco, Calif. The specific control technique used here is similar to the "stepping methods" described in that article. This article also discusses other methods which may be used such as a gradient technique (see Mode Oriented Methods).

As an alternative to the control of undergrate air by measurement of carbon dioxide, one can use the steam/fuel ratio as indicated at 53. This is especially useful for boilers with accurate measurements of fuel and steam flows, as well as to detect some undesirable conditions like fuel pile-up (build up) occurring in boilers. Thus, in general, the use of $CO_2$ or steam to fuel ratio either separately or in combination is determined by their respective confidence levels. Of course, the steam/fuel ratio is an ultimate measurement of boiler efficiency since it corresponds to a ratio of the output energy over the input energy. Thus, in effect, a cross limiting scheme is used with regard to the steam/fuel ratio to provide for variation in accordance with this ratio where perhaps heterogenous fuel bed conditions might warrant it. Note in the chart of FIG. 5 such ratio (S/F) is also shown as an alternative to carbon dioxide.

An alternate method for extremum control involves fitting one quadratic polynomial for $CO_2$ as a function of the past values of air/fuel ratio and fuel flow. A second quadratic polynomial for steam/fuel ratio is also fitted as a function of the past values of air/fuel ratio and fuel flow. A recursive exponentially weighted least square method, as given in the Section 7.3.1 in book DYNAMIC SYSTEM IDENTIFICATION by G. C. Goodwin and R. L. Payne, Academic Press, pp 180, 1977, was used for calculating (identifying) the polynomial parameter coefficients.

The theory of calculus is then used to find the expression to estimate the locations of air/fuel ratios where the maximum $CO_2$ and the maximum steam/fuel ratio values occur.

For example, let the steam/fuel ratio polynomial be given by $$S/F = A_1 A/F^2 + A2A/F + A_3F + A_4A/F \cdot F + A_5 \quad (1)$$

For $A_1 < 0$, the maximum steam to fuel ratio occurs when $$\frac{d\,S/F}{d\,A/F} = 0 = 2\,A_1\,A/F + A_2 + A_4\,F \quad (2)$$

i.e., $$A/F \text{ at max } S/F = \frac{-A_2}{2A_1} - \frac{A_4\,F}{2A_1} \quad (3)$$

where

S/F = steam/fuel ratio

A/F = air-to-fuel ratio $A_i$ = identified parameters for i = 1,2,3,4,5.

The expression for air/fuel ratio corresponding to the maximum $CO_2$, A/F at max $CO_2$ can be written similar to equation 3.

The extremum controller is then used to ramp up/-down the air/fuel ratio target in one of the following three ways:

a. A/F at maximum S/F b. A/F at maximum $CO_2$ c. An algebraic combination of item a and item b.

The key feature of this controller is that these air/fuel ratio values change with the variations in the composition and distribution of the fuel as well as the operating conditions of the boiler. The identification uses the actual measurements to update the two quadratic polynomial parameters as the new measurements become known, and predicts the air-to-fuel ratio values for the optimum steam/fuel ratio and $CO_2$ all the time.

The extremum controller 52 also has an opacity input 27 which is used to provide additional U.G. air if the O.F. air input is at a maximum. This is for the purpose of meeting, for example, EPA (Environmental Protection Agency) guidelines. The U.G. air indication 31 is ratioed with the steam output 19 or fuel input 29 and summed at 54 with the set point output of controller 52. This provides a U.G. air/steam or U.G. air/fuel error signal to the controller C5. Thus, this forms an intermediate control loop. Finally, the innermost control loop is formed by the summing at 56 which receives U.G. air input 31 and the output of controller C5 which when processed in the controller unit 57 is actually an undergrate air error signal which is the U.G. air control line 33.

Still referring to FIG. 3, overfire (O.F.) air is controlled by three parallel controllers C1, C2 and C3, only one of which is active at any one time, which have respective inputs of a combustible set point (S.P.), a carbon monoxide set point and an opacity set point as indicated. These are summed at 61, 62 and 63 with the respective actual values of these parameters. The selection of one of these three parameters to serve as a target for the O.F. air is indicated by a switch T. However, this selection is accomplished by a set of state transition logic equations shown in the Table I below. The resultant target on the line 64 is summed at 66 with an input at 67 which is a ratio of either O.F. air to steam or O.F. air to fuel. The resultant summation at 66 is an overfire error signal which is processed by controller C4. This, thus, constitutes an intermediate control loop. The final innermost control loop for O.F. air input 32 and control output 34 is accomplished by the summation unit 68 which receives the O.F. air input 32, the output of controller C4 and provides an O.F. air error signal to a controller 69 which drives the O.F. air control line 34.

In general, the intermediate control loop which uses the O.F. air steam or fuel ratio 67 is not absolutely necessary to this control scheme.

Thus, in partial summation of the present invention and referring to FIG. 3, the control of the undergrate air which might constitute as much as 80 percent of the total combustion air in many boilers is implemented by a measurement of carbon dioxide (and/or steam to fuel ratio) exclusively. Of course, measurement of oxygen concentration would be an equivalent. It is believed that there is no theoretical justification for the use of carbon monoxide for this purpose.

On the other hand, carbon monoxide is used (and as will be discussed later alternatively with the combustibles or opacity) to control overfire air. This is because the presence of carbon monoxide in the flue gas is mainly indicative of improper mixing of the O.F. air with carbon monoxide or of an approach to stoichiometric burning conditions in the oxidation zone above the bed. It reveals very limited information about the condition of the fire bed itself. On the other hand, it is believed the carbon dioxide measurement (or alternatively steam/fuel) reveals more as to the condition of the fire bed. Thus, the above represents a partial summation of the reason for the control system scheme as set out in FIG. 3.

TABLE I

| | | |
|---|---|---|
| T = 0 or 1 or 2 | | |
| Initialization: T = 1 i.e. CO regulation | | |
| State Transition Logic: | | |
| 3 | $T \rightarrow 0$ | if $CH_x > CH_{xx}$ and $OP < OP_x$ and $CO < CO_x$ |
| | Activate $CH_x$ control | if $CH_x > CH_{xsp} + CH_{DZ}$ and $OP < OP_{sp}$ and $CO < CO_{sp}$ |
| 2 | $T \rightarrow 1$ | if $CO > CO_x$ and $OP < OP_x$ |
| | Activate CO control | if $CO > CO_{SP} + CO_{DZ}$ and $CH_x < CH_{xsp}$ and $OP < OP_{sp}$ |
| 1 | $T \rightarrow 2$ | if $OP > OP_x$ |
| | Activate Opacity Control | if $OP > OP_{sp} + OP_{DZ}$ and $CH_x < CH_{xsp}$ |
| ↑ PRIORITY | | |

Figure 4:
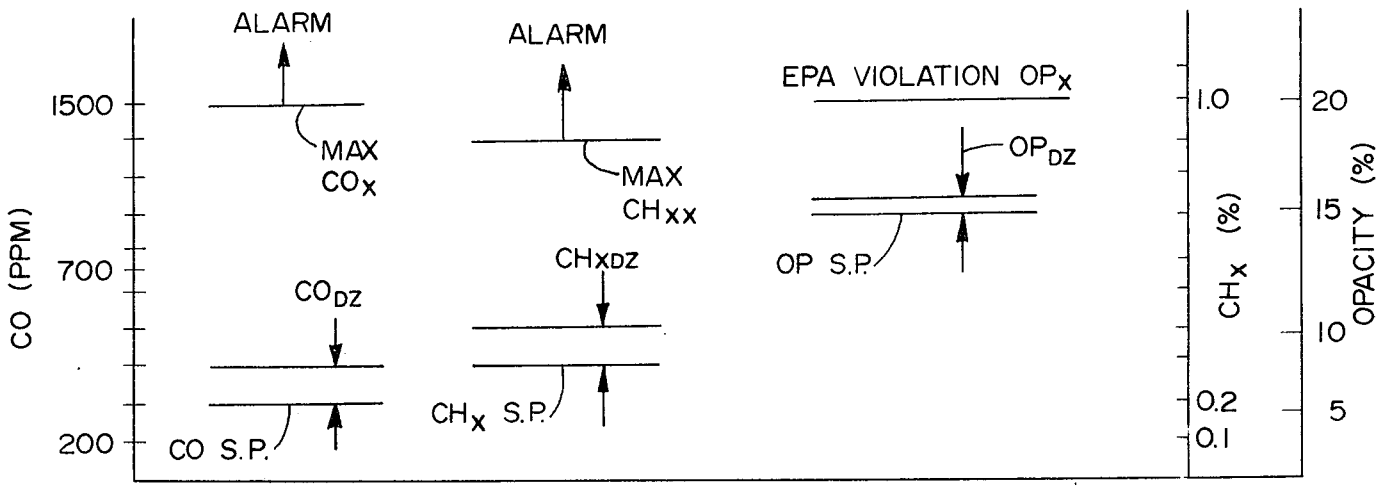
FIG. 4 is a chart illustrating the operation of FIG. 3.

Referring now to Table I and FIG. 4, these illustrate the transition logic equations for the choice of one of three parallel control inputs for the overfire air as illustrated in FIG. 3; that is, combustibles, carbon monoxide or opacity. The terms of the transition logic equations of Table I are equivalent to those designations in FIG. 4. Priority of control, as indicated, is opacity first, carbon monoxide second and $CH_x$ third. In general, opacity control will override carbon monoxide control if opacity exceeds a predetermined limit. And carbon monoxide control will override $CH_x$ control if the sensed value of carbon monoxide exceeds a predetermined limit.

This is all illustrated in FIG. 4 where, for example, referring to the carbon monoxide portion of the diagram, the carbon monoxide set point (CO S.P.) includes a carbon monoxide dead zone ($CO_{DZ}$). Such dead zone prevents hunting. Dead zones are also present in the other control channels. Maximum carbon monoxide level is indicated as $CO_x$ where an alarm condition occurs. The same is true of the maximum combustibles indicated as $CH_{xx}$. With regard to opacity, the EPA violation level is indicated as $OP_x$. Typical values to which the various set points are set range from 0.1 to 1 percent in the case of $CH_x$, 200 ppm to 1500 ppm in the case of carbon monoxide, and 10–20 percent for opacity. These values, of course, depend on the type of boiler and the type of specific fuel at any one time. Also, the values depend on applicable environmental regulations. For example, for good stoichiometric conditions, it may be that for one boiler or a certain type of bark fuel that the carbon monoxide set point should be more critically adjusted to a relatively lower value than the other set points. In any case, as is clear from this state transition logic, only one controller at a time in the case of overfire air is active. Table II shows actual operating data using the present invention from a bark and two coal fired stoker boilers.

TABLE II

| TYPE OF FUEL | BARK | COAL #1 | COAL #2 |
|---|---|---|---|
| Oxygen % | 4.2 | 10.1 | 9.5 |
| CO PPM | 580 | 171 | 233 |
| $CO_2$ % | 14.8 | 12.1 | 12.1 |
| Opacity % | ?* | 31.2 | — |
| Combustibles** % | .1 | .1 | .1 |
| Fuel Flow MPPH | 92 | 48 | 53 |
| Steam Flow MPPH | 254 | 158 | 154 |
| Undergrate Air Flow MPPH | 319 | 127 | 155 |
| Steam/Fuel Gain | 2.76 | 3.29 | 2.91 |
| Air/Fuel % (Air/Steam) | 139.5 | (79) | (100) |
| Overfire Air | Pressure 2.21" of Water | Flow 55 MPPH | Flow 29 MPPH |

*Uses wet scrubber, opacity is not important from EPA point-of-view.
**Measurements are unknown; values shown are estimated.

In a spreader stoker, the ignition plane moves upward through the bed in the same direction as the undergrate or primary air which supplies the oxygen required for combustion. Volatiles are released directly into the overfire zone for oxidation. Because of the suspension burning of fine fuel particles and volatiles, spreader stokers require a proper distribution of the secondary (overfire) air under all load conditions. Improper air distribution will result in a loss in boiler efficiency through the formation of soot (with attendant opacity problems) and excessive carry over of fly ash and combustible hydrocarbons up the stack. A weak fire about the bed will also cause an increase in the percentage of carbon-in-ash, through a loss of radiant heat directed at the fuel bed from above.

In a spreader stoker, the ignition plane is not well defined. Rather, it can be said to lie in two places: (1) at the root of the flame above the bed where suspension burning occurs; and (2) roughly parallel to the surface of the fuel bed. Volatiles are released directly in the secondary oxidation zone above the bed as the newly dropped coal sinks into the ignition plane. Since volatiles are allowed to reach the secondary oxidation zone of the spreader stoker without having to cross an ignition plane, a complete oxidation of these volatiles and the carbon monoxide rising from the fuel bed requires adequate supply and distribution of overfire air.

Figure 6:
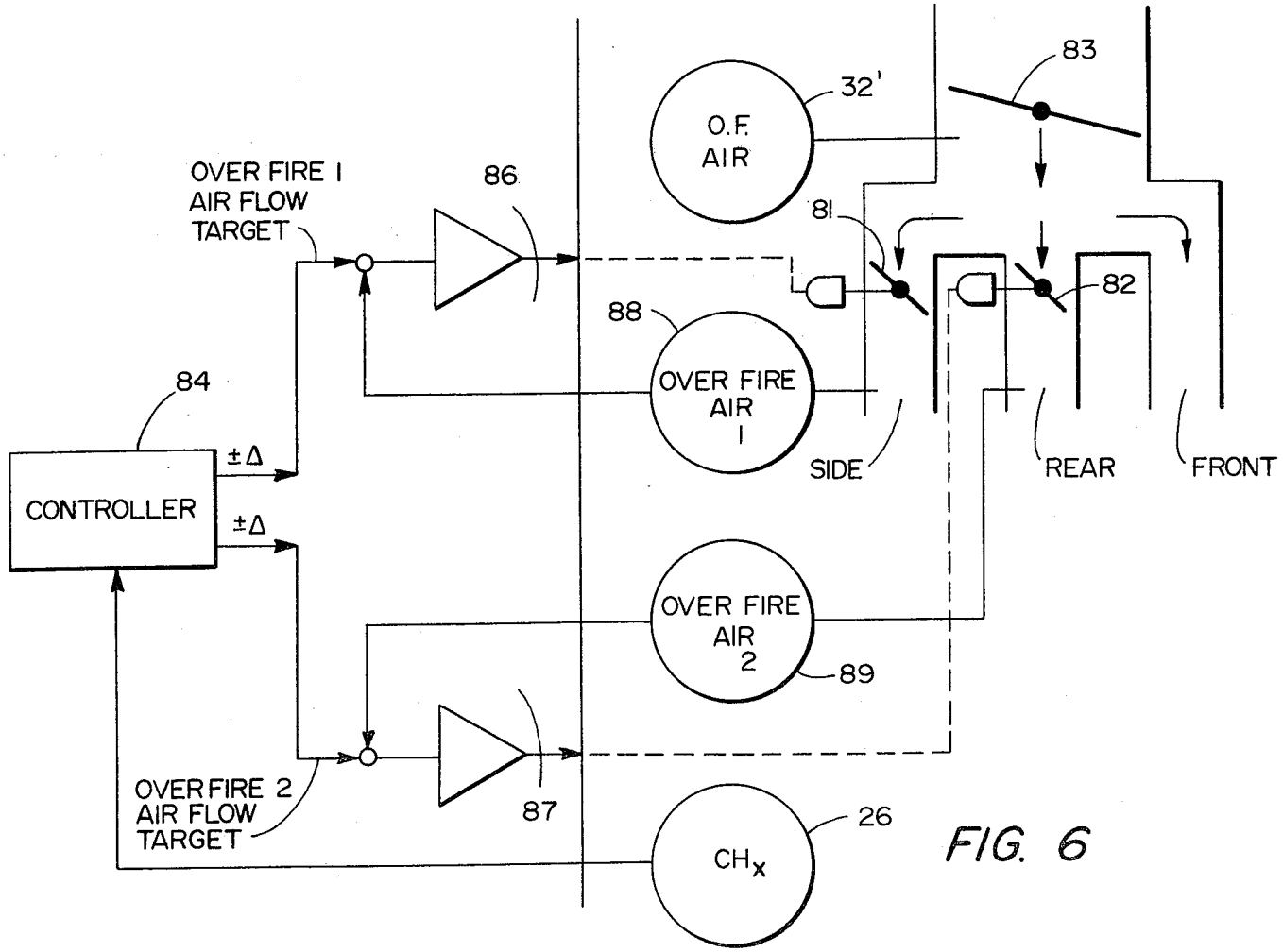
FIG. 6 is a circuit schematic and diagrammatic view of a portion of the air input of a boiler illustrating an alternative embodiment of the invention.

FIG. 6 illustrates a scheme for controlling the distribution of such overfire air. Here the main O.F. air flow is indicated by the sensor 32', and this is controlled by a vent or damper 83. Such vent would be normally controlled by the control output 34 shown in FIG. 3. However, this secondary air input is divided into side, rear and front channels. At least the front and rear channels have been shown in FIG. 2 as 44 and 46, 47 respectively. In the side and rear channels, as illustrated in FIG. 6, there are controllable vents 81 and 82. By the use of this overfire air duct work and the vents or dampers to determine the distribution of the air between the front, back and sides of the boiler, such a redistribution can greatly improve the efficiency of the boiler. As an aid to this distribution, the combustible channel 26 can be used. This is coupled to a controller 84 which conducts a two-dimensional search over an allowable range of overfire air flows to minimize the $CH_x$ value. Thus, controller 84 controls the control loops 86 and 87 which relate respectively to the control of the dampers 81 and 82. Feed back indications of the state of these dampers are provided by the units 88 and 89. Thus, by the use of a technique as shown in FIG. 6, combustibles can be minimized by the control of secondary air distribution. In addition, CO and opacity can similarly be minimized by the control of overfire air distribution.

Figure 7:
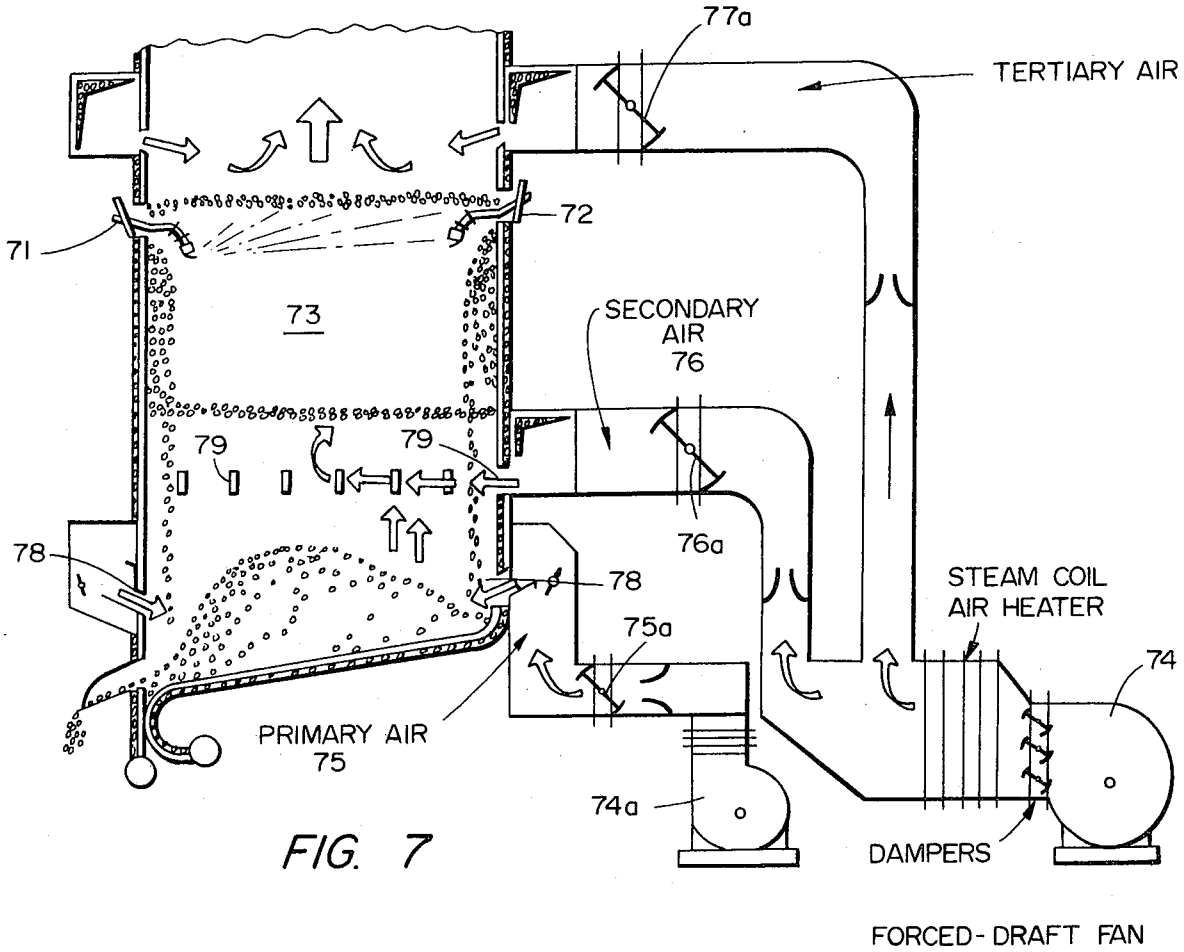
FIG. 7 is a diagrammatic view of a recovery boiler utilizing the present invention.

FIG. 7 illustrates a recovery boiler which utilizes the principle of the present invention. In general, a recovery boiler is, of course, used to process the black liquor formed in a paper making process. Spray nozzles 71 and 72 located at both sides of the furnace 73 discharge the black liquor in a finely atomized spray into the furnace. The air for combustion is furnished by forced draft fans 74 and 74*a;* and as illustrated, is divided into a primary air path 75, a secondary air path 76 and in some types of recovery boilers a tertiary air path 77. Appropriate air control vents 75*a,* 76*a* and 77*a* are used to determine the amounts of air.

Primary air 75 is admitted at the vents 78 at the fire bed level. However, in principle, it may be treated similarly and in fact in the context of the present invention may be termed undergrate air. Similarly, the secondary air 76 is admitted at the vents 79 and may be treated as overfire air. Tertiary air 77 is not present in all recovery boilers and for the purposes of this invention may be treated as part of the secondary air. Thus, from a control standpoint in referring to FIG. 3, primary air 75 and the secondary air 76, 77 is controlled in the same manner as undergrate and overfire air respectively.

In summary, the present invention provides an improved boiler control system.

What is claimed is:

1. A control system for a boiler producing steam having a fire bed of fuel where air is admitted under or at the fire bed (undergrate air) to accomplish the preliminary burning of fuel in said fire bed and air is admitted over the fire bed (overfire air) for completing combustion, said system comprising: means associated with the exhaust stack of said boiler for sensing carbon dioxide and carbon monoxide in the flue gas; means for controlling the amount of said undergrate air admitted into said boiler as a function of said carbon dioxide or steam/fuel ratio; means for controlling the amount of said overfire air admitted into said boiler as a function of said carbon monoxide.

2. A system as in claim 1 where said function of said carbon dioxide is of the extremum type.

3. A system as in claim 1 where said means for controlling said overfire air is also controlled as a function of combustibles in said flue gas and opacity of said flue gas and where only one of said three functions is active at any one time.

4. A system as in claim 3 where said opacity has the highest priority, carbon monoxide is of secondary priority and combustibles are of tertiary priority.

5. A system as in claim 3 where said secondary air is admitted to said boiler at a plurality of locations and said control means distributes said secondary air to minimize said combustibles.

6. A system as in claim 1 where control changes are made only after the system has settled from a previous change.

7. A system as in claim 1 where said boiler is of the recovery type having at least primary and secondary air inlets and where said undergrate air is said primary air and said overfire air is said secondary air.

8. A method of control of a boiler producing steam having a fire bed of fuel where air is admitted under or at the fire bed (undergrate air) to accomplish the preliminary burning of fuel in said fire bed and air is admitted over the fire bed (overfire air) for completing combustion, said method comprising the following steps: sensing carbon dioxide and carbon monoxide in the flue gas; controlling the amount of said undergrate air admitted into said boiler as a function of said carbon dioxide or steam/fuel ratio; and controlling the amount of said overfire air admitted into said boiler as a function of said carbon monoxide.

9. A method as in claim 8 where $CO_2$ is maximized and CO is controlled to a target value.

10. A method as in claim 8 where opacity and $CH_x$ (combustibles) is sensed and where said overfire air is also controlled as a function of said opacity and $CH_x$ as well as carbon monoxide (CO) and where opacity control overrides CO control if the opacity sensed value exceeds a predetermined limit and CO control overrides $CH_x$ control if CO exceeds a predetermined limit.

* * * * *